US006014778A

United States Patent [19]

Varnado

[11] Patent Number: 6,014,778

[45] Date of Patent: Jan. 18, 2000

[54] POOL COVER SYSTEM

[76] Inventor: Albert D. Varnado, 3109 Poinsettia Ave., Manhattan Beach, Calif. 90266

[21] Appl. No.: 09/292,577

[22] Filed: Apr. 15, 1999

[51] Int. Cl.[7] ..... E04H 4/00

[52] U.S. Cl. ..... 4/502; 4/498; 4/500; 242/919

[58] Field of Search ..... 4/502, 498, 500, 4/499, 501–504; 242/918, 919, 395

[56] References Cited

U.S. PATENT DOCUMENTS 3,076,975 2/1963 Lamb ..... 4/502
4,203,174 5/1980 Shults ..... 4/502
4,324,370 4/1982 Guard et al. ..... 4/502
5,701,613 12/1997 Richardson ..... 4/502

*Primary Examiner*—Henry J. Recla
*Assistant Examiner*—Tuan Nguyen

[57] ABSTRACT

A pool cover system for covering a pool. The pool cover system includes an elongate housing having a shaft extending along a longitudinal axis thereof. A pool cover is coupled to the shaft. The pool cover wraps around the shaft when the shaft rotates. A sprayer system is positioned in the housing and is designed to spray an outer surface of the cover as the cover is wrapped around the shaft.

7 Claims, 2 Drawing Sheets

POOL COVER SYSTEM

BACKGROUND OF THE INVENTION

1. Field of the Invention

The present invention relates to pool covers and more particularly pertains to a new pool cover system for covering a pool.

2. Description of the Prior Art

The use of pool covers is known in the prior art. More specifically, pool covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,203,174; U.S. Pat. No. 5,701,613; U.S. Pat. No. 2,898,607; U.S. Pat. No. 4,601,072; U.S. Pat. No. 3,076,975; and U.S. Pat. No. Des. 259,663.

While these devices fulfill their respective, particular objectives and requirements, the aforementioned patents do not disclose a new pool cover system. The inventive device includes an elongate housing having a shaft extending along a longitudinal axis thereof. A pool cover is coupled to the shaft. The pool cover wraps around the shaft when the shaft rotates. A sprayer system is positioned in the housing and is designed to spray an outer surface of the cover as the cover is wrapped around the shaft.

In these respects, the pool cover system according to the present invention substantially departs from the conventional concepts and designs of the prior art, and in so doing provides an apparatus primarily developed for the purpose of covering a pool.

SUMMARY OF THE INVENTION

In view of the foregoing disadvantages inherent in the known types of pool covers now present in the prior art, the present invention provides a new pool cover system construction wherein the same can be utilized for covering a pool.

The general purpose of the present invention, which will be described subsequently in greater detail, is to provide a new pool cover system apparatus and method which has many of the advantages of the pool covers mentioned heretofore and many novel features that result in a new pool cover system which is not anticipated, rendered obvious, suggested, or even implied by any of the prior art pool covers, either alone or in any combination thereof.

To attain this, the present invention generally comprises an elongate housing having a shaft extending along a longitudinal axis thereof. A pool cover is coupled to the shaft. The pool cover wraps around the shaft when the shaft rotates. A sprayer system is positioned in the housing and is designed to spray an outer surface of the cover as the cover is wrapped around the shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pool cover system apparatus and method which has many of the advantages of the pool covers mentioned heretofore and many novel features that result in a new pool cover system which is not anticipated, rendered obvious, suggested, or even implied by any of the prior art pool covers, either alone or in any combination thereof.

It is another object of the present invention to provide a new pool cover system which may be easily and efficiently manufactured and marketed.

It is a further object of the present invention to provide a new pool cover system which is of a durable and reliable construction.

An even further object of the present invention is to provide a new pool cover system which is susceptible of a low cost of manufacture with regard to both materials and labor, and which accordingly is then susceptible of low prices of sale to the consuming public, thereby making such pool cover system economically available to the buying public.

Still yet another object of the present invention is to provide a new pool cover system which provides in the apparatuses and methods of the prior art some of the advantages thereof, while simultaneously overcoming some of the disadvantages normally associated therewith.

Still another object of the present invention is to provide a new pool cover system for covering a pool.

Yet another object of the present invention is to provide a new pool cover system which includes an elongate housing having a shaft extending along a longitudinal axis thereof. A pool cover is coupled to the shaft. The pool cover wraps around the shaft when the shaft rotates. A sprayer system is positioned in the housing and is designed to spray an outer surface of the cover as the cover is wrapped around the shaft.

Still yet another object of the present invention is to provide a new pool cover system that washes the top of the cover as the cover is rolled up for storage, thereby removing much of the debris that has settled on the cover and preventing it from entering the pool.

Even still another object of the present invention is to provide a new pool cover system that protects the cover from the damaging rays of the sun.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
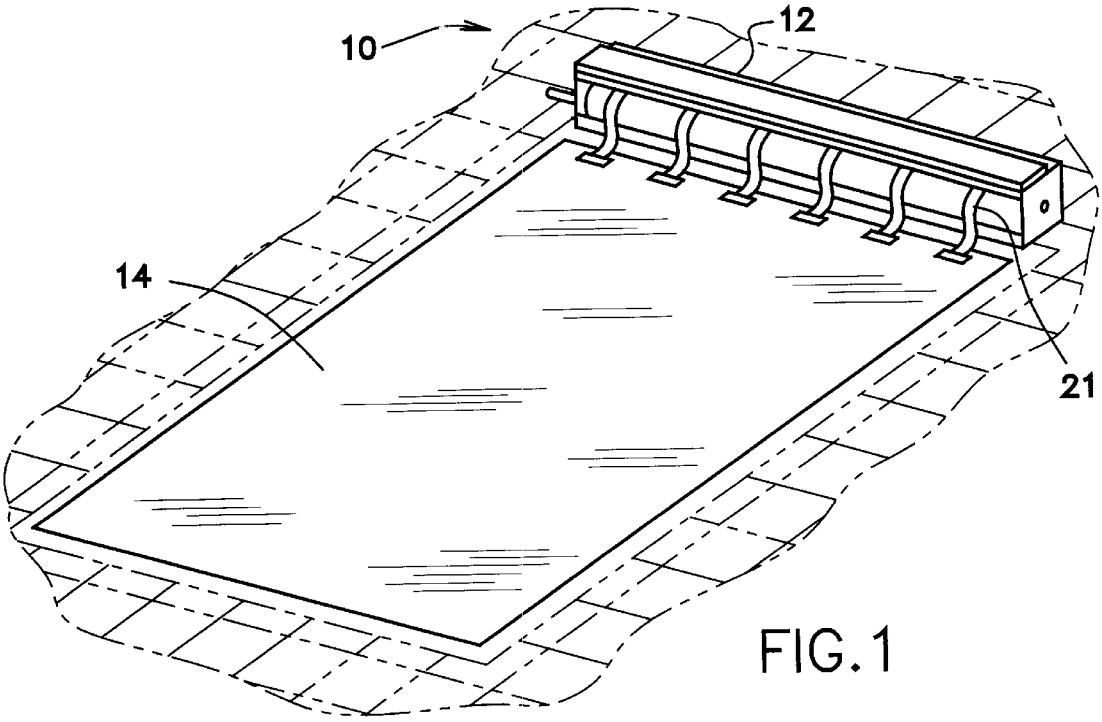
FIG. 1 is a schematic perspective view of a new pool cover system according to the present invention.

With reference now to the drawings, and in particular to FIGS. 1 through 4 thereof, a new pool cover system embodying the principles and concepts of the present invention and generally designated by the reference numeral 10 will be described.

As best illustrated in FIGS. 1 through 4, the pool cover system 10 generally comprises an elongate housing 12 having a shaft 13 extending along a longitudinal axis thereof. A pool cover 14 is coupled to the shaft. The pool cover wraps around the shaft when the shaft rotates. A sprayer system 15 is positioned in the housing and is designed to spray an outer surface of the cover as the cover is wrapped around the shaft. Because the sprayer system is positioned in the housing, the dirty water running off of the cover does not enter the pool but rather runs along the pavement to a drain.

Preferably, the housing has a front door 16 pivotally coupled to an upper edge of an open face 17 of the housing. The upper surface of the housing should be flat and horizontally oriented so that swimmers may sit on it, as should the front door in an open orientation. The housing protects the cover from damaging sunlight, thereby greatly increasing the life of the pool cover.

Also preferably, the shaft has a hand crank 18 extending from an end thereof. Alternative cranking mechanisms could include a motor, but the crank is preferably, since water is being sprayed on the cover while the cranking mechanism is in operation. Ideally, the shaft rotatably rests on opposite pairs of rollers 19. See FIG. 3.

The housing may have a plurality of casters 20 so that it may be moved to a designated area during pool use. The casters also space the housing from the ground so that its bottom dries out and doesn't rot.

Figure 2:
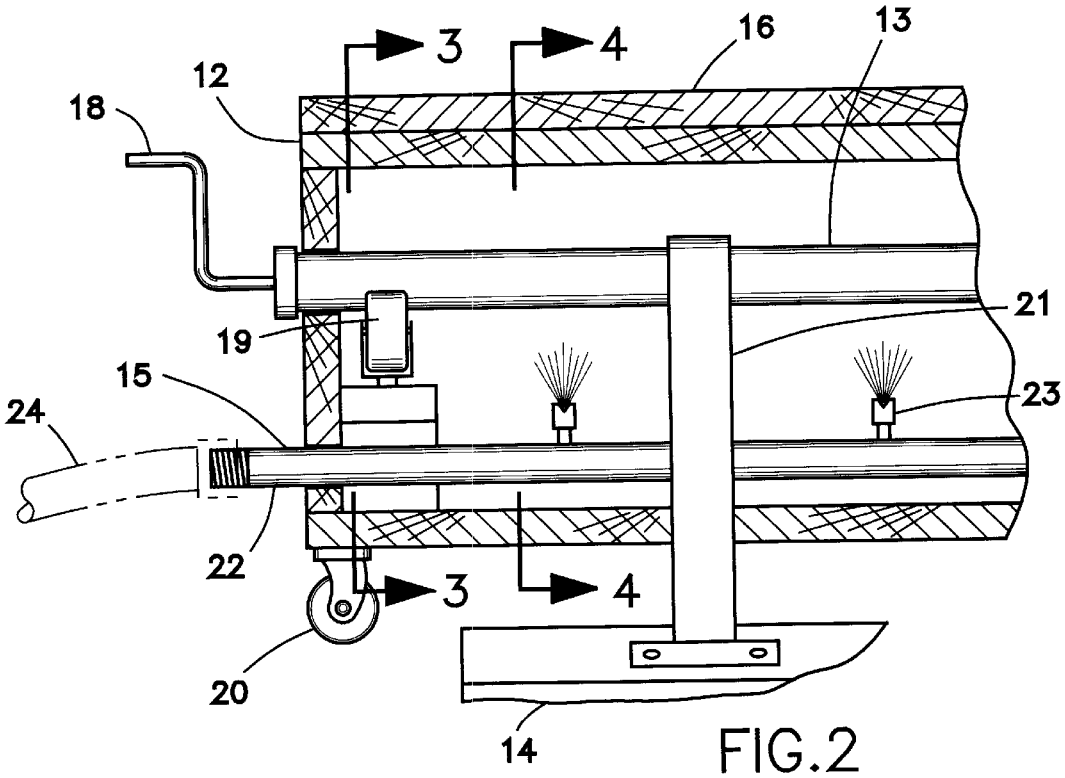
FIG. 2 is a schematic cross sectional view of the present invention.

Preferably, as best shown in FIGS. 1 and 2, the cover has a plurality of straps 21 extending from an end thereof. The straps are fixedly coupled to the shaft. The straps permit the cover to be fully inserted in the pool yet remain coupled to the shaft for rapid wrapping up.

Figure 3:
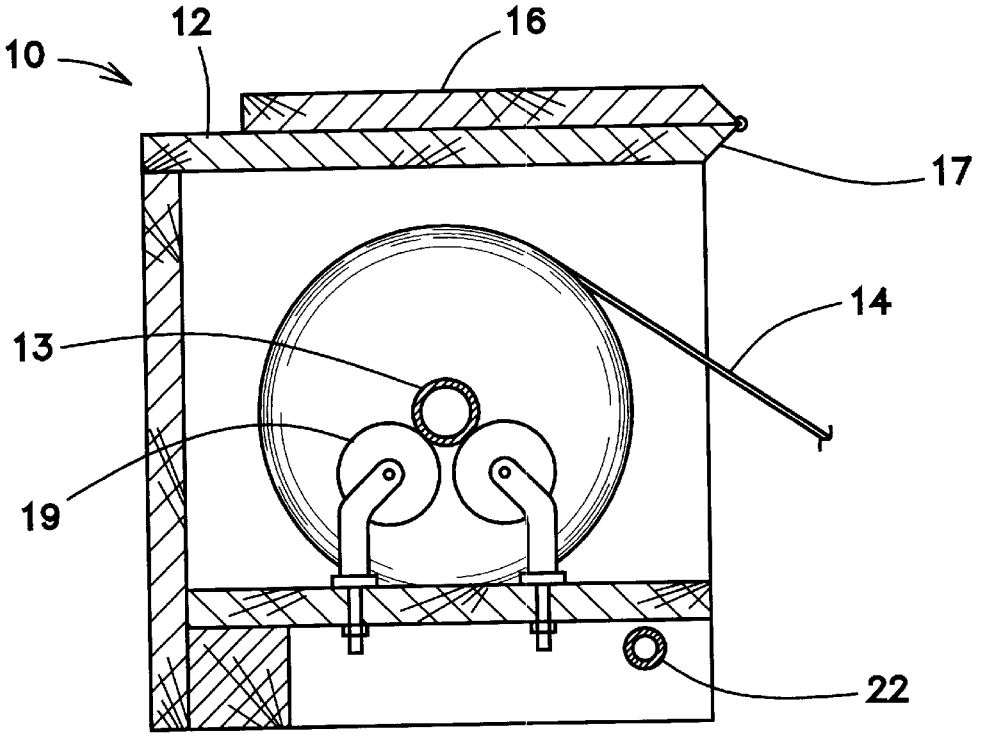
FIG. 3 is a schematic cross sectional end view of the present invention taken from line 3—3 of FIG. 2.
Figure 4:
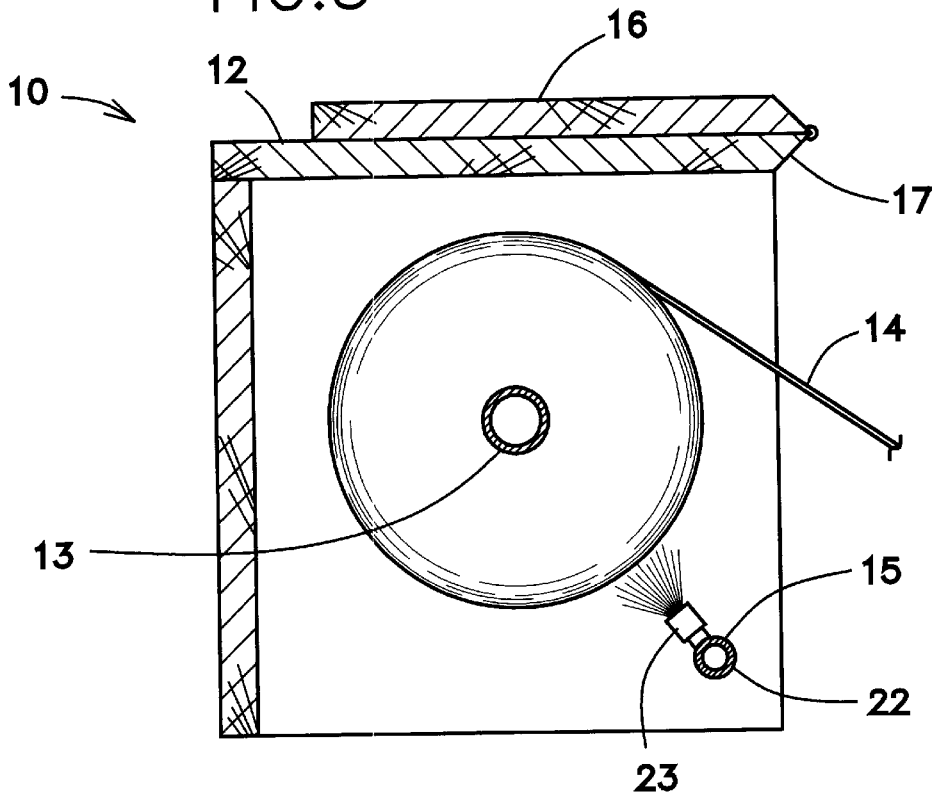
FIG. 4 is a schematic cross sectional end view of the present invention taken from line 4—4 of FIG. 2.

Preferably, the sprayer system includes a supply pipe 22 extending generally parallel the longitudinal axis of the housing and positioned below the shaft and towards the front opening of the housing as shown in FIG. 3. This positioning is required to blast debris away from the clean underside of the cover.

The supply line has a plurality of nozzles 23 extending therefrom towards the shaft. The nozzles are adapted for spraying fluid onto the cover. The nozzles should aim directly at the shaft to maximize the efficiency of the spray emitted by the nozzles.

In use, the front door of the housing is opened and the supply pipe is connected to a water source such as a garden hose 24 so that water sprays from the nozzles. The turn crank is turned to wrap the cover around the shaft. As the cover wraps around the shaft, the water cleans it. When finished, the water is turned off and the front door shut. To unroll the cover, its free end is merely pulled outwardly away from the housing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool cover system comprising in combination:

an elongate housing adapted to be positioned adjacent a pool edge having a shaft extending along a longitudinal axis thereof;

said housing has a front door pivotally coupled to an upper edge of an open face of said housing directed toward said pool a pool cover coupled to said shaft, said pool cover wrapping around said shaft when said shaft rotates; and a sprayer system positioned in said housing and adapted for spraying an outer surface of said cover as said cover is wrapped around said shaft.

2. The pool cover system of claim 1, wherein said shaft has a hand crank extending from an end thereof.

3. The pool cover system of claim 1, wherein said shaft rotatably rests on opposite pairs of rollers.

4. The pool cover system of claim 1, wherein said cover has a plurality of straps extending from an end thereof, said straps being fixedly coupled to said shaft.

5. The pool cover system of claim 1, wherein said sprayer system includes a supply pipe having a plurality of nozzles extending therefrom towards said shaft, said nozzles being adapted for spraying fluid onto said cover.

6. The pool cover system of claim 5, wherein said supply pipe extends generally parallel said longitudinal axis of said housing and is positioned below said shaft.

7. A pool cover system comprising in combination:

an elongate housing having a shaft extending along a longitudinal axis thereof;

a pool cover coupled to said shaft, said pool cover wrapping around said shaft when said shaft rotates;

a sprayer system positioned in said housing and adapted for spraying an outer surface of said cover as said cover is wrapped around said shaft;

said housing having a front door pivotally coupled to an upper edge of an open face of said housing;

said shaft having a hand crank extending from an end thereof;

said shaft rotatably resting on opposite pairs of rollers;

said cover having a plurality of straps extending from an end thereof, said straps being fixedly coupled to said shaft;

said sprayer system including a supply pipe extending generally parallel said longitudinal axis of said housing and positioned below said shaft; and said supply line having a plurality of nozzles extending therefrom towards said shaft, said nozzles being adapted for spraying fluid onto said cover.

* * * * *